US008564395B2

(12) United States Patent
Pan

(10) Patent No.: US 8,564,395 B2
(45) Date of Patent: Oct. 22, 2013

(54) SUPER HIGH POWER TRANSFORMER

(75) Inventor: Cheng-Yu Pan, New Taipei (TW)

(73) Assignee: Yujing Technology Co., Ltd, New Taipei (TW)

( * ) Notice: Subject to any disclaimer, the term of this patent is extended or adjusted under 35 U.S.C. 154(b) by 0 days.

(21) Appl. No.: 13/349,124

(22) Filed: Jan. 12, 2012

(65) Prior Publication Data

US 2012/0182110 A1 Jul. 19, 2012

(30) Foreign Application Priority Data

Jan. 17, 2011 (TW) ..... 100201013 U

(51) Int. Cl.
*H01F 17/04* (2006.01)
*H01F 27/28* (2006.01)
*H01F 27/02* (2006.01)

(52) U.S. Cl.
USPC ..... 336/221; 336/170; 336/220; 336/222; 336/223; 336/232; 336/83

(58) Field of Classification Search
USPC ..... 336/170, 220, 221
See application file for complete search history.

(56) References Cited

U.S. PATENT DOCUMENTS

| | | | | |
|---|---|---|---|---|
| 4,004,251 | A * | 1/1977 | Hesler et al. | 331/113 A |
| 5,095,357 | A * | 3/1992 | Andoh et al. | 257/379 |
| 7,091,817 | B2 * | 8/2006 | Peck et al. | 336/208 |
| 2008/0284551 | A1 * | 11/2008 | Chen et al. | 336/182 |
| 2010/0265029 | A1 * | 10/2010 | Xiong et al. | 336/232 |
| 2011/0090037 | A1 * | 4/2011 | Tsai et al. | 336/220 |

* cited by examiner

*Primary Examiner* — Elvin G Enad
*Assistant Examiner* — Kazi Hossain
(74) *Attorney, Agent, or Firm* — Lowe Hauptman & Ham LLP

(57) ABSTRACT

A super high power transformer includes a base, a plurality of plate bodies, and a plurality of isolating bodies. The base further includes a main core part, a plurality of opening slots, and a plurality of side wing parts. The main core part has a penetrating hole at the center thereof. Each of the plate bodies has an open hole for slipping on the main core part and a guided slot that has a pole lead on both sides thereof. Each of the isolating bodies has a through hole for slipping on the main core part and a guided slot. There is also a pole lead positioned on both sides of the guided slot. To be slipped on the main core part, the plurality of plate bodies and the insulating bodies are alternately stacked up with the plate bodies staggering in turning a 90-degree angle apart sequentially.

20 Claims, 2 Drawing Sheets

SUPER HIGH POWER TRANSFORMER

BACKGROUND OF THE INVENTION

1. Field of the Invention

The invention relates to a super high power transformer, and more particularly, to a super high power transformer that is capable of achieving the efficacy of making the transformer to be utilized on a high power of more than 3,000 watts by making use of a plurality of stacked-up thin copper plates.

2. Description of the Prior Art

Since the high technology in the field of microelectronics advances with giant stride, the relevant manufacturing process changes with each passing day, and the electronic products, having deepened into each family and all walks of life, become indispensable part in modern life.

Traditionally, the transformer for driving the light tube of the back-light-module in the LCD (Liquid Crystal Display) has a coil seat having a primary coil zone and a secondary coil zone and a plurality of computer terminals for connecting the electrically conductive wire to the winding and for brazing to the circuit board. As the technology keeps on making progress and under the demand of high luminance for the LCD, some manufacturers have already increased the number of light tube in the back-light-module in the LCD, as a result, the number of the transformer is also increased. Consequently, the size of the LCD is getting larger, and its weight is getting heavier too. Some manufacturers utilizes a single transformer to drive a number of light tubes, in this case, the power of the transformer needs to be increased to accommodate the high power output. In this way, using a single transformer to drive a number of light tubes, since both the primary coil and the secondary coil are wound around the same winding frame making the room of the winding zone of the primary coil very limited. Therefore, the number of the winding coil on the primary coil zone and the secondary coil zone need to be increased, as a result, the thickness and the volume of the transformer will be increased accordingly.

Moreover, as the loading power increases, significant problem of temperature rise in the primary coil will be generated which will result in over-heat phenomenon. An increase in the diameter of the coil in the primary coil may resolve the problem of temperature rise, but it will further increase the thickness of the transformer. What is more, in above-mentioned transformers of the prior art, if the problems of "safety regulation and isolation" of the "primary coil and the secondary coil" wound around the same winding frame is considered, the extent of difficulty of voltage durability on the high voltage winding is relatively higher making the manufacturing and cost of the parts of the transformer relatively unfavorable.

Therefore, just how to resolve the above-mentioned problems has become an urgent issue to seek for an improving program in the industry.

SUMMARY OF THE INVENTION

In light of the above-mentioned disadvantages of the prior art, the invention provides a super high power transformer that is capable of overcoming the shortcomings of the prior art, satisfying the requirements of the industry, as well as improving the competitiveness in the market. It aims to ameliorate at least some of the disadvantages of the prior art or to provide a useful alternative.

The primary objective of the invention is to provide a super high power transformer to achieve the efficacy of making the transformer to be utilized on a high power of more than 3,000 watts by making use of a plurality of stacked-up thin copper plates, The secondary objective of the invention is to provide a super high power transformer to achieve the efficacy of saving more time in assembling and manufacturing process.

The third objective of the invention is to provide a super high power transformer to achieve the efficacy of fast heat-dissipating by furnishing a penetrating hole in a base.

To achieve the above-mentioned objective, a super high power transformer of the invention includes a super high power transformer includes a base, a plurality of plate bodies, and a plurality of isolating bodies. The base includes a main core part, a plurality of opening slots, and a plurality of side wing parts. The main core part being a polygon in shape, having a first vertex angle formed at the connection of its two adjacent sides and with a first radius of curvature "r1", and further having a penetrating hole at the center thereof Each of the opening slots is correspondent with the first vertex angle and each of the side wing part is correspondent with the side of the main core part. There is a spacing "S" between the side wing part and the side of the main core part and a second vertex angle with a second radius of curvature "r2". Each of the plate bodies has an open hole for slipping on the main core part and a guided slot that has a pole lead on both sides thereof Each of the isolating body has a through hole for slipping on the main core part and a guided slot that is correspondent with the opening slot. There is also a pole lead positioned on both sides of the guided slot. The isolating body being disposed in between the stacked-up plate body has a through hole for slipping on the main core part. The plurality of plate bodies and the insulating bodies are alternately stacked up with the plate bodies staggering in turning a 90-degree angle apart sequentially. By making use of a plurality of plate bodies to alternately stack up on the main core part, each of the opening slots is correspondent with at least a guided slot.

The accomplishment of this and other objectives of the invention will become apparent from the following description and its accompanying drawings of which:

DETAILED DESCRIPTION OF THE PREFERRED EMBODIMENT

Figure 1:
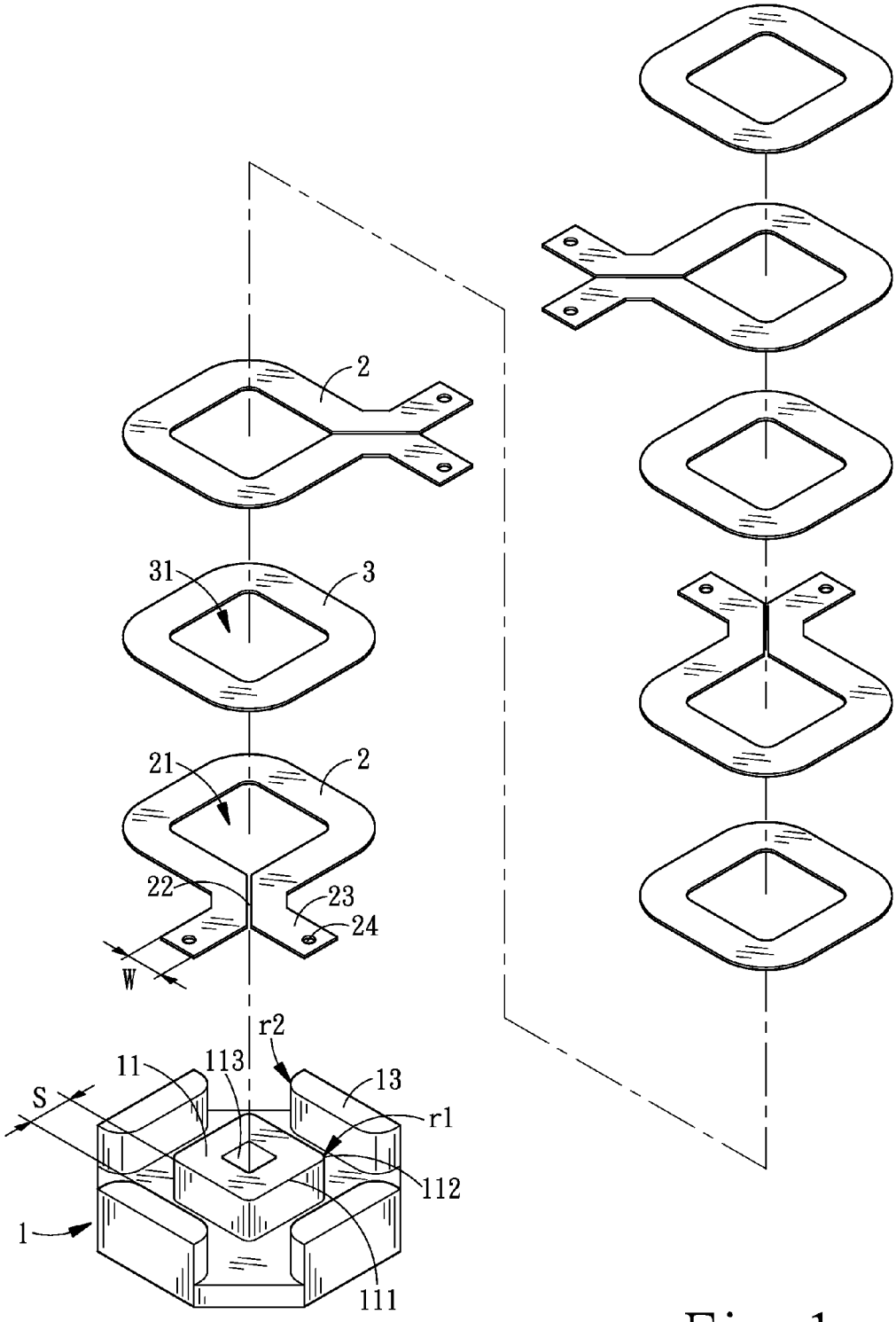
FIG. 1 is an isometric exploded view of the super high power transformer of the preferred embodiment of the invention.
Figure 2:
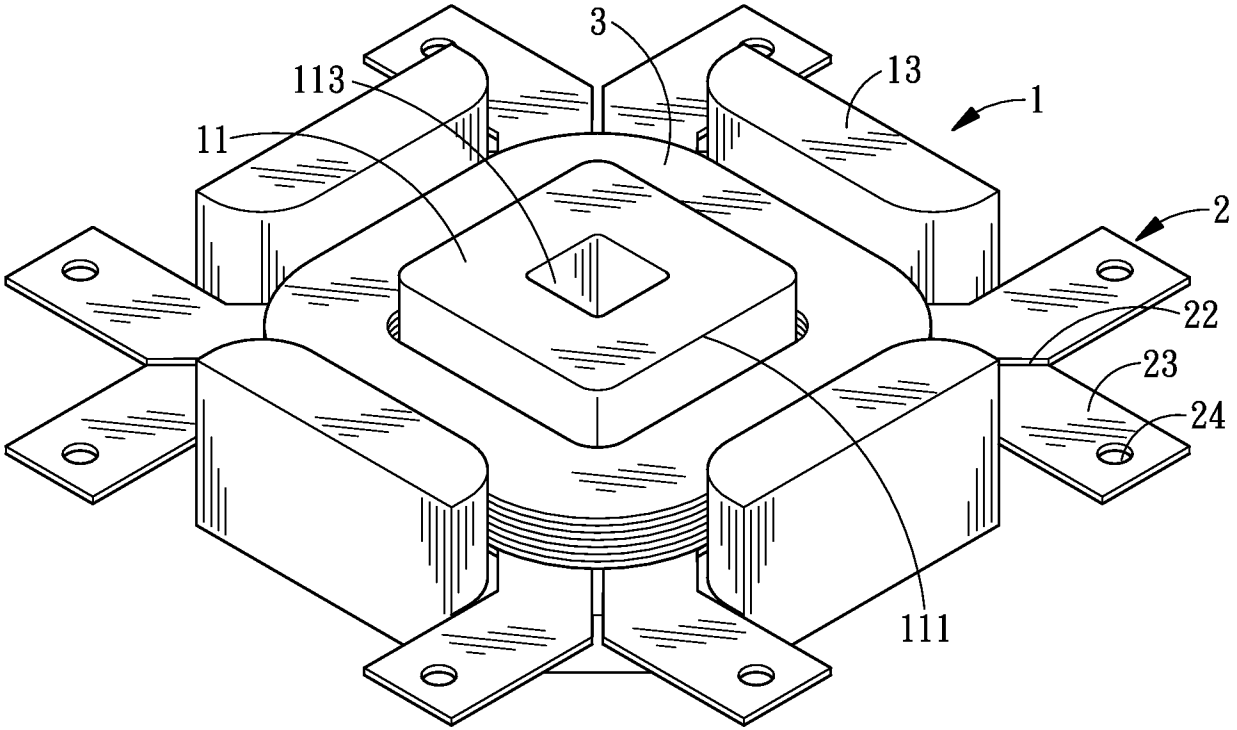
FIG. 2 is an isometric view of the assembled super high power transformer of the preferred embodiment of the invention.

FIG. 1 is an isometric exploded view of the super high power transformer of the preferred embodiment of the invention while FIG. 2 is an isometric view of the assembled super high power transformer of the preferred embodiment of the invention. As shown in FIG. 1 and FIG. 2, the super high power transformer of the invention includes a base (1), a plurality of plate body (2), and a plurality of insulating body (3).

The base (1) further includes a main core part (11), a plurality of open slots (12), and a plurality of side wing parts (13). The main core part (11) being in a polygonal shape is a square in shape in a preferred embodiment of the invention. Of course, the main core part (11) can also be in pentagon or hexagon shapes, all such kind of variation can be made according to the above-mentioned description to those people skilled in the art without departing from the scope or spirit of the invention, thereby, it is not necessary to repeat here. What is more, a first vertex angle (112) is formed by extending the two adjacent sides (111) of the main core part (11). The first vertex angle (112) being in arcuate shape possesses a first radius of curvature r1 that has the magnitude between 1 mm to 5 mm. The main core part (11) further possesses a penetrating hole (113) that being with a similar shape corresponding to the main core part (11) is capable of providing an increase in heat-dissipating surface area to achieve the efficacy of fast heat-dissipating. The plurality of opening slots (12) is one-to-one correspondent with the first vertex angle (112). In a preferred embodiment of the invention, the number of the opening slot (12) is four making the base (1) become an octagon in shape. The plurality of side wing parts (13) is one-to-one correspondent with the sides (111) of the main core part (11) and there is a spacing "S" between the side wing part (13) and the sides (111). There is also a second vertex angle (131) at the side wing part (13) adjacent to the opening slot (12). The second vertex angle (131) being in arcuate shape possesses a second radius of curvature r2 that has the magnitude between 6 mm to 10 mm to facilitate the increase of the space of the opening slot (12).

In a preferred embodiment of the invention, each of the plate body (2) being a tin-plated copper plate is integrally formed by punching process. Moreover, each of the plate body (2) has an opening (21), a guided slot (22), and two pole leads (23). The opening (21) is used for slipping on the main core part (11) making the plate body (2) being placed in the spacing "S" between the side wing part (13) and the main core part (11). The guided slot (22) being positioned on a side of the opening (21) is corresponding to the opening slot (12). Each side of the guided slot (22) has a pole lead (23) making the two pole leads (23) disposed on both sides of the guided slot (22) respectively. The pole lead (23) has a width "W" that is capable of being adjusted in accordance with the requirement of the various resistances. What is more, the pole lead (23) also has a circular hole (24) for providing the connection for various circuit layouts.

In a preferred embodiment of the invention, when the plurality of plate bodies (2) and the insulating bodies (3) are alternately stacked up with the plate bodies (2) staggering in turning a 90-degree angle apart sequentially and are slipped on the main core part (11), the isolating bodies (3) having a through hole (31) and being in annular shape are capable of being slipped on by the main core part (11) through the circumference thereof and placed within the plurality of side wing parts (13). The plurality of plate bodies (2) and the insulating bodies (3) are alternately stacked up with the plate bodies (2) staggering in turning a 90-degree angle apart sequentially making each of the opening slots (12) correspond with at least a guided slot (22) to provide the connection for various circuit layouts. The isolating body (3) being made of electrically non-conductive material is capable of preventing themselves from being electrically communicative to become short-circuit. In this way, by making use of the plurality of the alternately stacking-up plate bodies, the super high power transformer of the invention is capable of replacing the coil wound by the enamel covered wire of the prior art to achieve the efficacies of saving space and diminishing the loss due to the eddy current making the super high power transformer of the invention to be utilized on a high power of more than 3,000 watts.

In a conclusion, the super high power transformer of the invention is capable of substantially resolving the demerits of the prior art, satisfying the requirements and improving the competitiveness of the industry in the field, thereby, is possessing the patentability of having the non-obviousness subject matter and the applicability in the industry in the field.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. A transformer, comprising:

a base comprising:

a main core part being a polygon in shape, and having a plurality of sides, a plurality of corners each formed at a connection of two adjacent sides among the plurality of sides, and a penetrating hole at a center part of the polygon, a plurality of side wing parts being one-to-one correspondent with and spaced from the sides of the main core part, and a plurality of opening slots being one-to-one correspondent with the corners of the polygon, each of the opening slots being formed between two adjacent side wing parts among the plurality of side wing parts;

a plurality of plate bodies each having an annular part having a polygonal open hole for slipping on the main core part, the annular part having first and second ends spaced from each other, first and second connection parts connected to the first and second ends of the annular part, respectively, wherein the first and second connection parts are spaced from each other by a guided slot extending diagonally from a corner of the polygonal open hole, and a pair of pole leads on opposite sides of the guided slot and connected to the first and second connection parts, respectively; and a plurality of isolating bodies each being annular in shape and having a through hole for slipping on the main core part;

wherein the plate bodies and the isolating bodies are alternately stacked up on the main core part which is received in the open holes of the plate bodies and the through holes of the isolating bodies, each of the opening slots is correspondent with at least one guided slot of the plate bodies, the first and second connection parts of each of the plate bodies extend side-by-side, while being spaced from each other by the respective guided slot, through the corresponding opening slot, and the pole leads of the plate bodies project further outwardly from the corresponding connection parts and beyond the opening slots corresponding to at least two corners among the corners of the polygon.

2. The transformer as claimed in claim 1, wherein each of the plate bodies is a tin-plated copper plate.

3. The transformer as claimed in claim 1, wherein the shape of the penetrating hole is a polygon correspondent with the shape of the polygon of the main core part.

4. The transformer as claimed in claim 1, wherein each of the pole leads has a width substantially same as a width of the corresponding annular part around the corresponding open hole.

5. The transformer as claimed in claim 1, wherein each of the pole leads has a hole.

6. The transformer as claimed in claim 1, wherein the guided slots of the plate bodies are arranged in an angularly staggered manner with respect to each other.

7. The transformer as claimed in claim 6, wherein the pole leads of each of the plate bodies are angled relative to each other and also angled relative to the first and second connection parts, respectively.

8. The transformer as claimed in claim 7, wherein the guided slots of adjacent plate bodies among the stacked plate bodies are 90 degrees apart from each other.

9. The transformer as claimed in claim 1, wherein the pole leads of each of the plate bodies extend obliquely away from each other and also obliquely relative to the first and second connection parts, respectively.

10. The transformer as claimed in claim 9, wherein the pole leads of each of the plate bodies are angled relative to each other at about 90 degrees.

11. A transformer, comprising:

a base comprising:

a polygonal main core part, a plurality of side wing parts arranged around the main core part and spaced from the main core part, and a plurality of opening slots each being formed between two adjacent side wing parts among the plurality of side wing parts;

a plurality of plate bodies each having an annular part having an open hole, the annular part having first and second ends spaced from each other, first and second connection parts connected to the first and second ends of the annular part, respectively, wherein the first and second connection parts are spaced from each other by a guided slot connected with the open hole, and a pair of pole leads on opposite sides of the guided slot and connected to the first and second connection parts, respectively; and a plurality of isolating bodies each having a through hole; wherein the plate bodies and the isolating bodies are alternately stacked up on the main core part which is received in the open holes of the plate bodies and the through holes of the isolating bodies, each of the opening slots corresponds to the guided slot of at least one of the plate bodies, the first and second connection parts of each of the plate bodies extend side-by-side, while being spaced from each other by the respective guided slot, diagonally from a corner of the polygonal main core part through the corresponding opening slot, and the guided slots of adjacent plate bodies among the stacked plate bodies are angled relative to each other.

12. The transformer as claimed in claim 11, wherein each of the pole leads has a width substantially same as a width of the corresponding annular part around the corresponding open hole.

13. The transformer as claimed in claim 11, wherein the pole leads of each of the plate bodies are angled relative to each other and also angled relative to the first and second connection parts, respectively.

14. The transformer as claimed in claim 13, wherein the pole leads of each of the plate bodies are angled relative to each other at about 90 degrees.

15. The transformer as claimed in claim 14, wherein the guided slots of adjacent plate bodies among the stacked plate bodies are angled relative to each other at 90 degrees.

16. The transformer as claimed in claim 11, wherein the guided slots of adjacent plate bodies among the stacked plate bodies are angled relative to each other at 90 degrees.

17. A transformer, comprising:

a base comprising:

a main core part, a plurality of side wing parts arranged around the main core part and spaced from the main core part, and a plurality of opening slots each being formed between two adjacent side wing parts among the plurality of side wing parts;

a plurality of plate bodies each having an annular part having an open hole, the annular part having first and second ends spaced from each other, first and second connection parts connected to the first and second ends of the annular part, respectively, wherein the first and second connection parts are spaced from each other by a guided slot connected with the open hole, and a pair of pole leads on opposite sides of the guided slot and connected to the first and second connection parts, respectively; and a plurality of isolating bodies each having a through hole; wherein the plate bodies and the isolating bodies are alternately stacked up on the main core part which is received in the open holes of the plate bodies and the through holes of the isolating bodies, each of the opening slots corresponds to the guided slot of at least one of the plate bodies, the first and second connection parts of each of the plate bodies extend side-by-side, while being spaced from each other by the respective guided slot, through the corresponding opening slot, and the pole leads of each of the plate bodies extend obliquely away from each other.

18. The transformer as claimed in claim 17, wherein each of the pole leads has a width substantially same as a width of the corresponding annular part around the corresponding open hole.

19. The transformer as claimed in claim 17, wherein the guided slots of adjacent plate bodies among the stacked plate bodies are angled relative to each other at 90 degrees.

20. The transformer as claimed in claim 17, wherein the pole leads of each of the plate bodies are angled relative to each other at about 90 degrees.

* * * * *